US006782999B1

(12) United States Patent
McCoy et al.

(10) Patent No.: US 6,782,999 B1
(45) Date of Patent: Aug. 31, 2004

(54) TRAVEL TOOTHBRUSH SYSTEM

(76) Inventors: Katrina M. McCoy, 38310 Edward St., Dade City, FL (US) 33525; James E. Kunkle, 38310 Edward St., Dade City, FL (US) 33525

( * ) Notice: Subject to any disclaimer, the term of this patent is extended or adjusted under 35 U.S.C. 154(b) by 0 days.

(21) Appl. No.: 10/087,618

(22) Filed: Mar. 1, 2002

(51) Int. Cl.[7] ..... B65D 69/00
(52) U.S. Cl. ..... 206/223; 206/362.2; 132/309
(58) Field of Search ..... 206/361, 362, 206/362.1, 362.2, 15.2, 581, 209.1, 37; 132/309–311

(56) References Cited

U.S. PATENT DOCUMENTS 2,640,488 A * 6/1953 Velodota ..... 312/308
3,727,748 A * 4/1973 Brown ..... 206/362.1
4,957,125 A * 9/1990 Yaneza ..... 132/309
4,978,003 A * 12/1990 Foster ..... 206/217
4,997,629 A * 3/1991 Marchand et al. ..... 422/300
5,215,193 A * 6/1993 Dennis ..... 206/223
5,388,599 A * 2/1995 Yen ..... 132/311
D376,979 S * 12/1996 Davidson, III ..... D9/504
5,605,242 A * 2/1997 Hwang ..... 220/8
5,894,926 A * 4/1999 Stafford ..... 206/362.2
5,922,292 A * 7/1999 Hecker et al. ..... 422/300
6,186,324 B1 * 2/2001 Catterson ..... 206/362.1
6,526,991 B2 * 3/2003 Bodwalk ..... 132/309

* cited by examiner

*Primary Examiner*—Shian Luong

(57) ABSTRACT

A travel toothbrush system that includes a keychain structure for attaching keys and a toothbrush that is attachable to the keychain structure so that the toothbrush has an enlarged handle for use.

1 Claim, 1 Drawing Sheet

TRAVEL TOOTHBRUSH SYSTEM

TECHNICAL FIELD

The present invention relates to toothpaste and toothbrush combinations and more particularly to a travel toothbrush system that includes a toothbrush having an externally threaded bottom handle portion, a tube of toothpaste, a container having an internally threaded mouth opening, a lid having an externally threaded plug portion, and a keychain lid member having an externally threaded keychain lid member bottom portion and a key ring hole.

BACKGROUND OF THE INVENTION

It is important for many individuals to brush at various times during the day in order to maintain and promote oral hygiene. Although it is advantageous to brush frequently, it is often difficult for individuals to maintain a toothbrush and toothpaste supply in a convenient manner. It would be desirable, therefore, to have a travel toothbrush system that allowed an individual to incorporate a toothbrush and toothpaste tube into a keychain which is typically always carried by the user and readily available for brushing when the opportunity presents itself.

SUMMARY OF INVENTION

It is thus an object of the invention to provide a travel toothbrush system that includes a toothbrush having an externally threaded bottom handle portion, a tube of toothpaste, a container, a lid having an externally threaded plug portion, and a keychain lid member having an externally threaded keychain lid member bottom portion and a key ring hole; the container having an internally threaded mouth opening in connection with a cavity formed therein of sufficient size to hold the toothpaste tube and the toothbrush simultaneously; the internally threaded mouth opening being threaded to companionately engage the external threads of the externally threaded plug portion; the lid further including an internally threaded opening having internal threads companionate with the external threads of the externally threaded bottom handle portion and the externally threaded keychain lid member bottom portion; in a travel configuration, the toothpaste tube and the toothbrush are positioned within the cavity, the externally threaded plug portion is threaded into the internally threaded mouth opening, and the externally threaded keychain lid member bottom portion is threaded into the internally threaded opening of the lid; in a use mode, the externally threaded plug portion is un-threaded from the internally threaded mouth opening and the toothpaste tube and the toothbrush removed from the cavity, the externally threaded keychain lid member bottom portion is un-threaded from the internally threaded opening of the lid, the externally threaded bottom handle portion is threaded into the internally threaded opening of the lid, and the externally threaded plug portion is threaded into the internally threaded mouth opening allowing the container to function as an elongated handle for the toothbrush.

Accordingly, a travel toothbrush system is provided.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
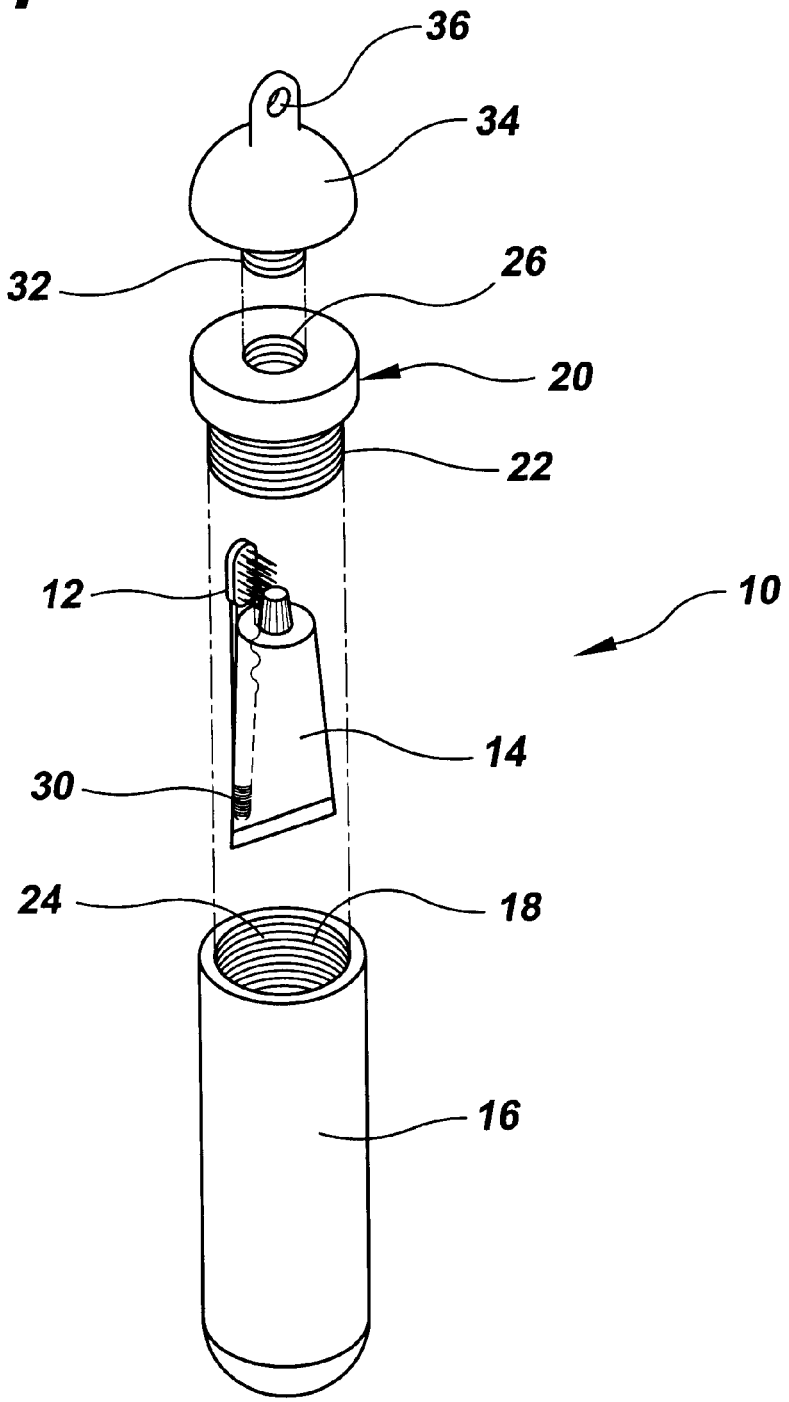
FIG. 1 shows an exemplary exploded embodiment of the toothbrush travel system of the present invention.

FIG. 1 shows an exemplary embodiment of the travel toothbrush system of the present invention generally designated 10. Travel toothbrush system 10 includes a toothbrush, generally designated 12; a tube of toothpaste, generally designated 14; a container, generally designated 16, having an internally threaded mouth opening 17 in connection with a cavity 18 sized to simultaneously receive the toothbrush 12 and the tube of toothpaste 14; a lid, generally designated 20; and a keychain lid, generally designated 34.

Lid 20 has an externally threaded plug portion 22 that is adapted to threadably engage the internal threading 24 of internally threaded mouth opening 18 of container 16. Lid 20 also includes an internally threaded hole 26 that is companionately threaded to engage the threaded bottom portion 30 of toothbrush 12 and a threaded bottom portion 32 of keychain lid 34.

The threaded bottom portion 30 of toothbrush 12 is threaded into internally threaded hole 26 to configure the travel toothbrush system 10 in a tooth brushing mode. The internally threaded hole 26 of lid 20 is sealed by threaded bottom portion 32 of keychain lid 34 when the travel toothbrush system 10 is in the travel mode.

It can be seen from the preceding description that a travel toothbrush system has been provided.

It is noted that the embodiment of the travel toothbrush system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A travel toothbrush system comprising:

a toothbrush having an externally threaded bottom handle portion;

a tube of toothpaste;

a container;

a lid having an externally threaded plug portion; and a keychain lid member having an externally threaded keychain lid member bottom portion and a key ring hole;

the container having an internally threaded mouth opening in connection with a cavity formed therein of sufficient size to hold the toothpaste tube and the toothbrush simultaneously;

the internally threaded mouth opening being threaded to companionately engage the external threads of the externally threaded plug portion;

the lid further including an internally threaded hole having internal threads companionate with the external threads of the externally threaded bottom handle portion and the externally threaded keychain lid member bottom portion.

* * * * *